US006472815B1

(12) United States Patent
Ueda et al.

(10) Patent No.: US 6,472,815 B1
(45) Date of Patent: Oct. 29, 2002

(54) FLUORESCENT LUMINOUS DEVICE INCLUDING CATHODES THAT RECEIVE INDEPENDENTLY CONTROLLED VOLTAGES

(75) Inventors: Kinya Ueda; Yukihiko Shimizu; Masao Saito; Satoshi Yamaguchi; Yoichi Kobori; Hiroshi Yamaguchi, all of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/578,447

(22) Filed: May 26, 2000

(30) Foreign Application Priority Data

May 27, 1999 (JP) ..... 11-148533

(51) Int. Cl.[7] ..... H01K 1/62; H01K 63/04

(52) U.S. Cl. ..... 313/496; 313/492; 313/497; 315/169.1

(58) Field of Search ..... 313/496, 492, 313/497, 585, 308; 347/241, 258, 226; 315/169.1, 169.3, 167

(56) References Cited

U.S. PATENT DOCUMENTS 4,293,783 A * 10/1981 Kojima et al. ..... 313/497
4,737,686 A * 4/1988 Harvey ..... 313/584
5,565,742 A * 10/1996 Shichao et al. ..... 315/366
5,592,206 A * 1/1997 Watanabe et al. ..... 347/122
5,847,745 A * 12/1998 Shimizu et al. ..... 347/227
5,907,349 A * 5/1999 Shimizu et al. ..... 347/238
6,002,414 A * 12/1999 Kobori et al. ..... 347/123
6,147,697 A * 11/2000 Deguchi et al. ..... 347/238
6,191,805 B1 * 2/2001 Shimizu et al. ..... 347/241
6,329,759 B1 * 12/2001 Tanaka et al. ..... 315/169.3

* cited by examiner

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

A fluorescent luminous device which is capable of eliminating arrangement of independently controllable control electrodes and a power supply for applying a negative potential to the control electrodes. A plurality of anode chains and a plurality of filamentary cathodes are arranged in a manner to correspond to each other. A potential across the cathodes is changed over between a zero or negative potential and a positive potential to control the anode dots.

6 Claims, 11 Drawing Sheets

FLUORESCENT LUMINOUS DEVICE INCLUDING CATHODES THAT RECEIVE INDEPENDENTLY CONTROLLED VOLTAGES

BACKGROUND OF THE INVENTION

This invention relates to a fluorescent luminous device including cathodes and a plurality of anode dots, and more particularly to a fluorescent luminous device effectively available as a printer head for optical writing, a graphic display device for displaying any desired characters or figures and the like. When the fluorescent luminous device of the present invention is used as a printer head, it may be commonly applied to various kinds of optical printers for writing on a photosensitive drum, writing on a photosensitive film and the like.

Now, a conventional fluorescent printer head will be described with reference to FIG. 11. A conventional fluorescent printer head generally designated at reference numeral 100 includes an anode substrate 102 constituting a part of an envelope, which anode substrate is provided thereon with two anode chains 107 and 108 each constituted of a plurality of anode dots 106. The anode dots 106 of the anode chain 107 and those of the anode chain 108 are arranged in an offset manner with respect to each other. The respective two anode dots 106 of the anode chains 107 and 108 obliquely opposite to each other and adjacent to each other are connected together and led out to one side of the anode chains 107 and 108, resulting in being connected to an IC acting as an anode drive means. The fluorescent printer head 100 also includes a first cathode 112 and a second cathode 113 stretchedly arranged above the anode chains 107 and 108, respectively. Further, the fluorescent printer head 100 includes a shield electrode 120 arranged between the anodes chains 107 and 108, as well as a first control electrode 130 and a second control electrode 131 respectively arranged outside the first and second cathodes 112 and 113, with the cathodes 112 and 113 and shield electrode 120 being interposed between the first control electrode 130 and the second control electrode 131. The shield electrode 120 has a positive voltage constantly applied thereto. The respective two anode dots 106 of the anode chains 107 and 108 obliquely opposite to each other are driven in order by the IC. In synchronism with the driving, the control electrode 130 or 131 has a selection signal fed thereto. When this results in the first control electrode 130 being selected, electrons are permitted to enter between the first control electrode 130 and the shield electrode 120, to thereby impinge on the anode dots 106 of the anode chain 107 to which a drive signal is fed. In this instance, the second control electrode 131 has a negative voltage applied thereto to form an electric field, which prevents electrons emitted from the second cathode 113 from impinging on the anode dots 106.

Thus, in the conventional fluorescent printer head 100 thus constructed, it is required that the first and second control electrodes 130 and 131 which are constructed so as to be controlled independently from each other are arranged for the respective anode chains 107 and 108 in order to select the anode chains. Also, the conventional fluorescent printer head 100 requires a power supply for applying a negative potential to each of the first and second control electrode 130 and 131.

Also, in order to increase an anode potential to enhance luminance in the conventional fluorescent printer head 100, it is required to increase a negative potential of the non-selected control electrode to prevent leakage luminescence of the non-selected selected anode chain. Further, this requires to increase a capacity of the power supply for negative potential application.

In addition, an increase in negative potential of the non-selected control electrode by increasing an anode potential causes a potential difference between the anode an the control electrode to be highly increased. However, in the fluorescent printer head 100, the control electrodes 130 and 131 and anode wirings are arranged in proximity to each other in a vertical direction so as to be spaced from each other at a distance as small as 10 to 20 $\mu$m, so that an increase in potential difference therebetween causes dielectric breakdown to readily occur in the envelope.

SUMMARY OF THE INVENTION

The present invention has been made in view of the foregoing disadvantage of the prior art.

Accordingly, it is an object of the present invention to provide a fluorescent luminous device which is capable of eliminating arrangement of independently controllable control electrodes and a power supply for applying a negative potential to the control electrodes.

It is another object of the present invention to provide a fluorescent luminous device which is capable of being small-sized and reduced in manufacturing cost.

It is a further object of the present invention to provide a fluorescent luminous device which is capable of minimizing dielectric breakdown between electrodes.

In accordance with the present invention, a fluorescent luminous device is provided. The fluorescent luminous an anode substrate and an anode including a plurality of anode chains each constituted of a plurality of anode dots arranged so as to be spaced from each other at predetermined intervals on the anode substrate. The anode dots of the anode chains which correspond to each other are connected together. The fluorescent luminous device also includes an anode drive means for driving the anode dots of the anode, cathodes arranged above the anode chains, respectively, and a cathode selection means for applying a voltage to the cathodes independently from each other to select the anode chains.

In a preferred embodiment of the present invention, the cathode selection means applies a positive potential to the cathodes non-selected and a zero or negative potential to the cathodes selected.

In a preferred embodiment of the present invention, the fluorescent luminous device further includes a shield electrode arranged between each two of the cathodes so as to separate spaces above the anode chains from each other. The shield electrode has a zero or positive potential applied thereto.

In a preferred embodiment of the present invention, the fluorescent luminous device further includes a cut-off electrode having a potential lower than a positive potential which is applied to the cathodes applied thereto.

In a preferred embodiment of the present invention, the positive potential applied to the cathodes is lower than a positive potential applied to the anode.

In a preferred embodiment of the present invention, the fluorescent luminous device further includes a shield electrode arranged between each two of the cathodes so as to separate spaces above the anode chains from each other and a cut-off electrode for preventing electrons from being discharged from the non-selected cathodes to the anode chains corresponding thereto. The shield electrode and cut-off electrode are integrally constructed so as to cover the cathodes and have a potential lower than a positive potential which is applied to the cathodes applied thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
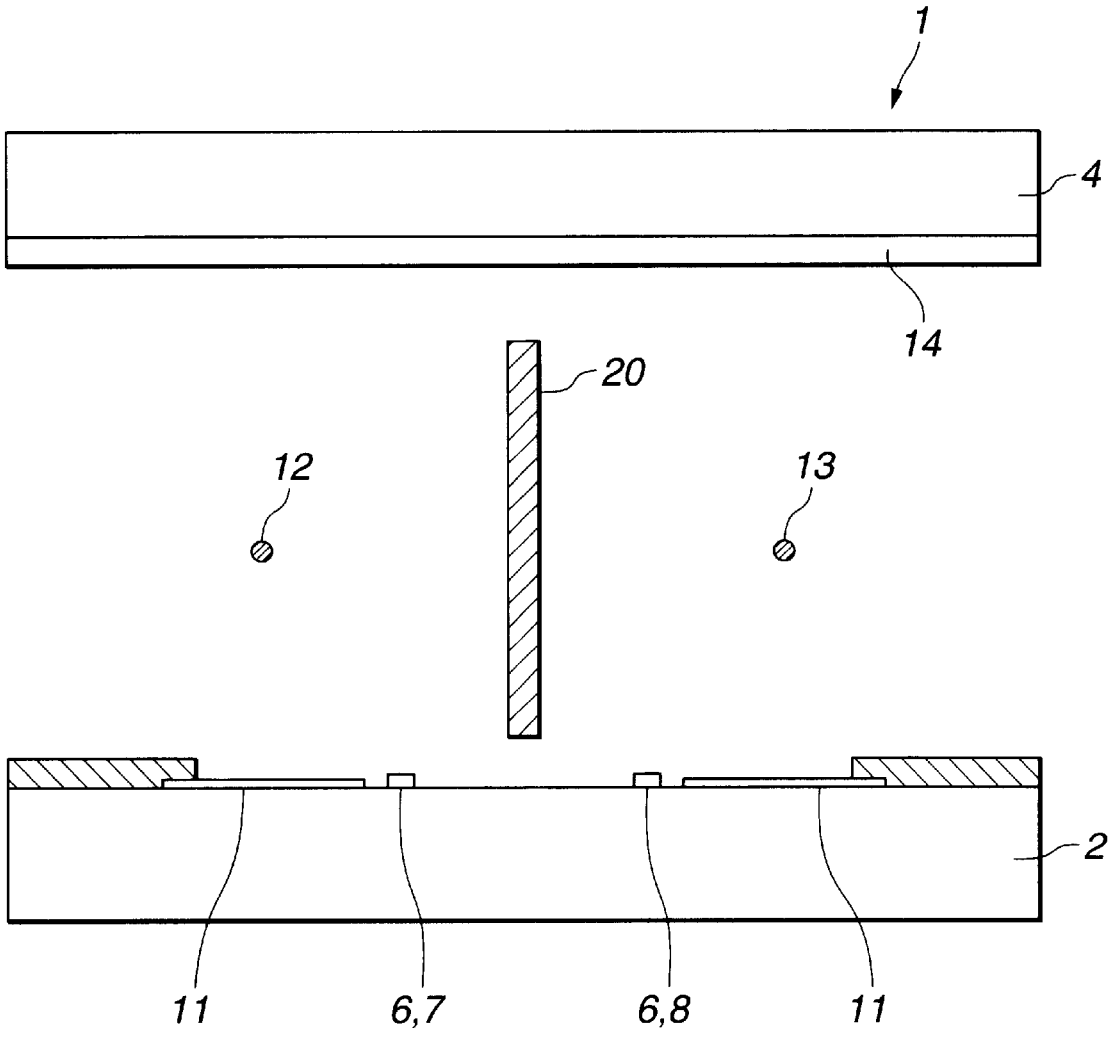
FIG. 1 is a schematic sectional view showing a first embodiment of a fluorescent luminous device according to the present invention.
Figure 2:
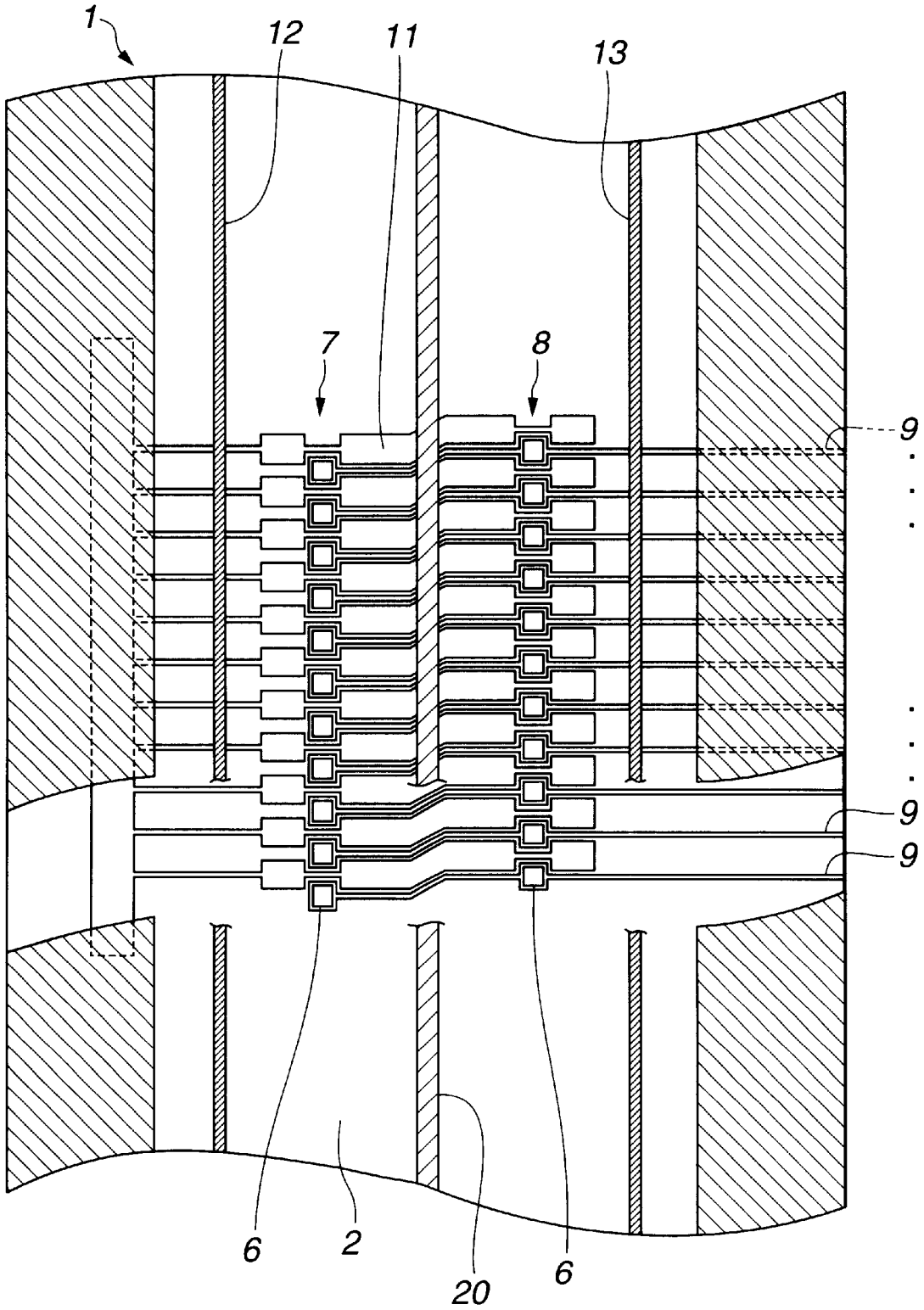
FIG. 2 is a fragmentary plan view of the fluorescent luminous device shown in FIG. 1.

Now, a fluorescent luminous device according to the present invention will be described hereinafter with reference to FIGS. 1 to 10.

Referring first to FIGS. 1 to 4, a first embodiment of a fluorescent luminous device according to the present invention is illustrated. A fluorescent luminous device generally designated at reference numeral 1 is configured in the form of a fluorescent printer head which is adapted to be used as a writing means (light source) for an optical printer. The fluorescent printer head 1 includes an envelope (not shown) of a box-like shape formed by sealedly joining an anode substrate 2, side plates (not shown) and a rear substrate 4 to each other by means of a sealing glass material. The envelope thus formed is evacuated at a high vacuum.

The anode substrate 2 is provided on an inner surface thereof with a first anode chain 7 and a second anode chain 8 so as to extend in a longitudinal direction of the anode substrate 2. The first and second anode chains 7 and 8 each are constituted of a plurality of anode dots 6. The anode dots 6 each include a frame-like conductive film formed of aluminum or the like and arranged on the anode substrate 2 and a phosphor layer deposited on the frame-like conductive film. The first anode chain 7 and second anode chain 8 are arranged in juxtaposition to each other in a direction perpendicular to the longitudinal direction of the anode substrate 2. The anode dots 6 of the first anode chain 7 and those of the second anode chain 8 are arranged so as not to be aligned with or directly opposite to each other in the longitudinal direction of the anode substrate 2. More particularly, the anode dots 6 of the first and second anode chains 7 and 8 corresponding to each other are arranged in an offset manner or in a manner to be obliquely opposite to each other. The respective two anode dots 6 of the anode chains 7 and 8 corresponding to each other or obliquely opposite to each other are connected together or in common and led out to one side of the first and second anode chains 7 and 8 by means of anode wirings 9, to thereby be connected to an IC (not shown) acting as a dynamic drive means.

The anode substrate 2 is provided on an upper surface hereof with flat control electrodes 11. The flat control electrodes 11 each are formed of a conductive film made of aluminum or the like and are arranged in the same plane as the anode dots 6 while cooperating with each other to surround the anode dots 7 and anode wirings 9. During driving of the device, the flat control electrodes 11 have a positive voltage constantly applied thereto, to thereby render an electric field thereabout uniform.

The fluorescent luminous device 1 of the illustrated embodiment also includes a first filamentary cathode 12 and a second filamentary cathode 13 stretchedly arranged in the envelope (not shown) in a manner to be positioned above the first and second anode chains 7 and 8 and so as to extend along the anode chains 7 and 8, respectively. The first cathode 12 and second cathode 13 are configured so as to be subject to on/off control independently from each other. Thus, the first and second cathodes 12 and 13 are arranged so as to be electrically and structurally independent from each other.

The rear substrate 4 is formed on an inner surface thereof with a nesa film 14 for the antistatic purpose which is a light-permeable conductive film. The nesa film 14 is formed on a front surface thereof with an antifriction layer, which functions to absorb light emitted from the anode dots to prevent the light from being reflected toward the anode dots.

The fluorescent luminous device 1 of the illustrated embodiment further includes a shield electrode 20 arranged between the first anode chain 7 and the second anode chain 8. The shield electrode 20 is formed to be flat and arranged so as to be vertical to the anode substrate 2. The shield electrode 20 is positioned at a lower end thereof above the anode substrate with a small gap being defined therebetween. In the illustrated embodiment, the gap may be defined to be about 0.15 mm. An insulating layer may be interposed between a lower end of the shield electrode 20 and the anode substrate 2. Also, the shield electrode 20 is positioned at an upper end thereof above the first cathode 12 and second cathode 13, to thereby prevent electrons emitted from the cathodes 12 and 13 from entering the opposite side beyond the shield electrode 20. An interval or gap between the shield electrode 20 and the anode substrate 2 as large as about 1 mm causes electrons emitted from one of the cathodes to be possibly spread to a degree sufficient to impinge on the anode dots of which luminescence is not intended. The shield electrode 20 is arranged so as to eliminate such a problem. Thus, when the anode chains 7 and 8 are arranged so as to be spaced from each other at an interval increased sufficiently to avoid such a problem, such arrangement of the shield electrode is not necessarily required.

Figure 3:
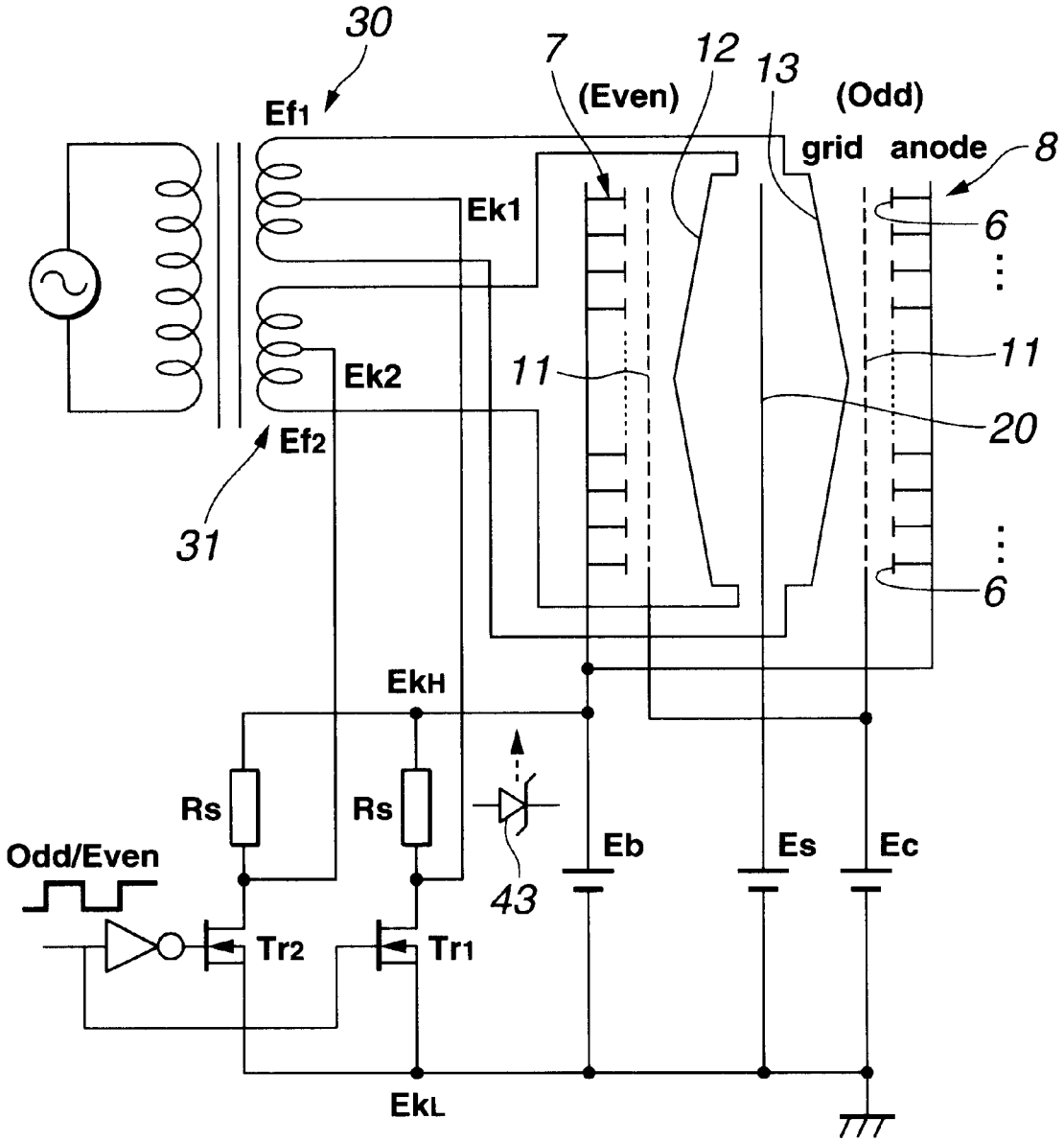
FIG. 3 is a circuit diagram showing a drive circuit for driving the fluorescent luminous device shown in FIG. 1.

Now, a drive circuit for the fluorescent luminous device of the illustrated embodiment will be described with reference to FIG. 3.

The anode dots 6 of the first anode chain 7 and second anode chain 8 which are selected by the IC have an anode potential Eb constantly applied thereto. In the illustrated embodiment, the anode potential Eb may be set to be 40 V. The respective two anode dots 6 of the first and second anode chains 7 and 8 corresponding to each other or obliquely opposite to each other are connected together and driven in common by the IC.

The first cathode 12 and second cathode 13 are driven by transformers 30 and 31 arranged independently from each other so as to act as power supplies therefor, respectively. Thus, during driving of the fluorescent luminous device, the cathodes 12 and 13 are kept heated, to thereby be ready for emitting electrons therefrom. The transformers 30 and 31 have center taps drawn out of secondary windings thereof, respectively, across which center tap potentials Ek1 and Ek2 are induced. The center tap potentials Ek1 and Ek2 are changed over by a cathode selection means described hereinafter, to thereby select one of the cathodes 12 and 13, so that selection between the anode chains 7 and 8 may be carried out.

More particularly, the center tap potentials Ek1 and Ek2 are connected through pull-up resistors Rs to the anode potential Eb and grounded through switching elements Tr1 and Tr2, respectively. The switching elements Tr1 and Tr2 each have a gate fed with an ON or OFF change-over signal. Feeding of the ON signal to the gate permits the switching element to be turned on, so that the center tap potential connected thereto is a low-side cathode potential Ek1=0V. Feeding of the OFF signal to the switching element permits it to be kept turned off, resulting in the center tap potential connected thereto being a high-side cathode potential Ekh=40V. Changing-over of a duty ratio of the change-over signal permits a timing of the change-over to be optionally varied or adjusted, so that selection between two such cathodes 12 and 13 may be carried out independently from each other.

The shield electrode 20 has a shield electrode potential Es constantly applied thereto. The shield electrode potential is set to be zero or positive. In the illustrated embodiment, it may be set to be, for example, 5V (Es=5V).

The flat control electrodes 11 each have a flat control electrode potential Ec constantly applied thereto. The flat control electrode potential Ec is set to be positive. In the illustrated embodiment, it may be set to be, for example, 40V (Ec=40V).

Figure 4:
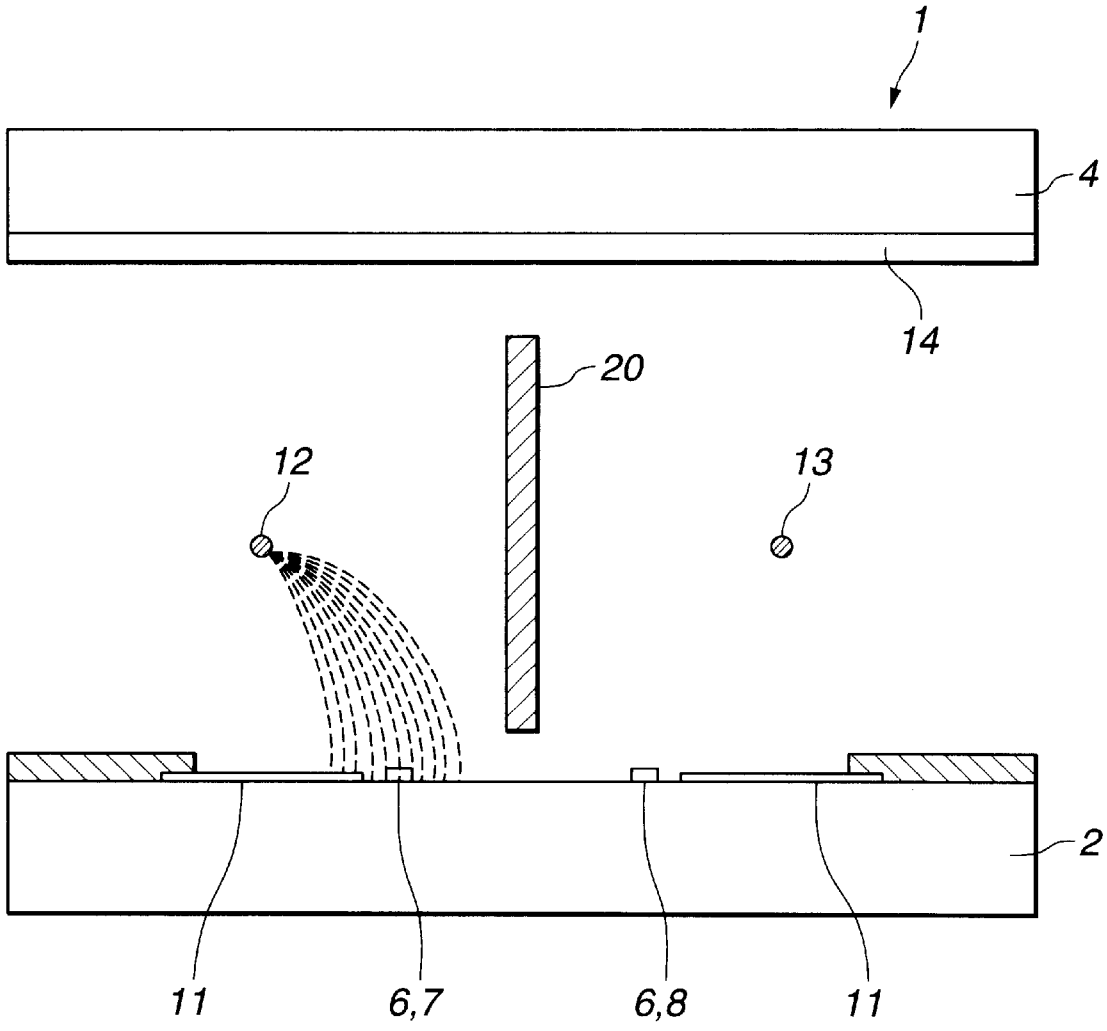
FIG. 4 is a schematic sectional view showing an electric field produced in the fluorescent luminous device of FIG. 1 during driving thereof.

Now, the manner of operation of the fluorescent printer head 1 of the illustrated embodiment thus constructed will be described with reference to FIG. 4.

The first cathode 12 and second cathode 13 have electric power constantly fed thereto, so that they may emit electrons when an effective potential exists between the cathodes and the anode chains 7 and 8. The cathodes 12 and 13 are configured so as to be controllable independently from each other, so that selection of the anode chain 7 or 8 may be carried out by changing over the center tap potentials Ek1 and Ek1 into Ek1=0V or Ekh=4V. For example, in FIG. 4, supposing that the cathode 12 arranged on a left-hand side of the shield electrode 20 is set to be Ek1=0V, a potential difference between the first cathode 12 and the first anode chain 7 and that between the the cathode 12 and the flat control electrodes 11 are Eb–Ek1=40V and Ec–Ek1=40V, respectively, to thereby permit electrons to be emitted from the first cathode 12 and reach the anode dots 6. At this time, the second cathode 13 arranged on a right-hand side of the shield electrode 20 is set at Ekh=40V, so that a potential difference between the second cathode 13 and the second anode chain 8 and that between the second cathode 13 and the flat control electrodes 11 are Eb–Ekh=0V and Ec–Ekh=0V, respectively, to thereby keep electrons from being emitted from the second cathode 13.

In the illustrated embodiment, the respective two anode dots 6 of the anode chains 7 and 8 corresponding to each other are driven in order by the IC. Also, in synchronism with the driving, a selection signal at a zero potential or a positive potential is applied to the first and second cathodes 12 and 13. This permits luminescence of desired anode dots 6. In synchronism with such luminescence of the fluorescent printer head 1, the fluorescent printer head 1 and a record medium are moved relatively to each other in a direction perpendicular to a direction in which the first and second anode chains 7 and 8 are arranged, resulting in a desired image or a latent image thereof being formed on the record medium.

Figure 5:
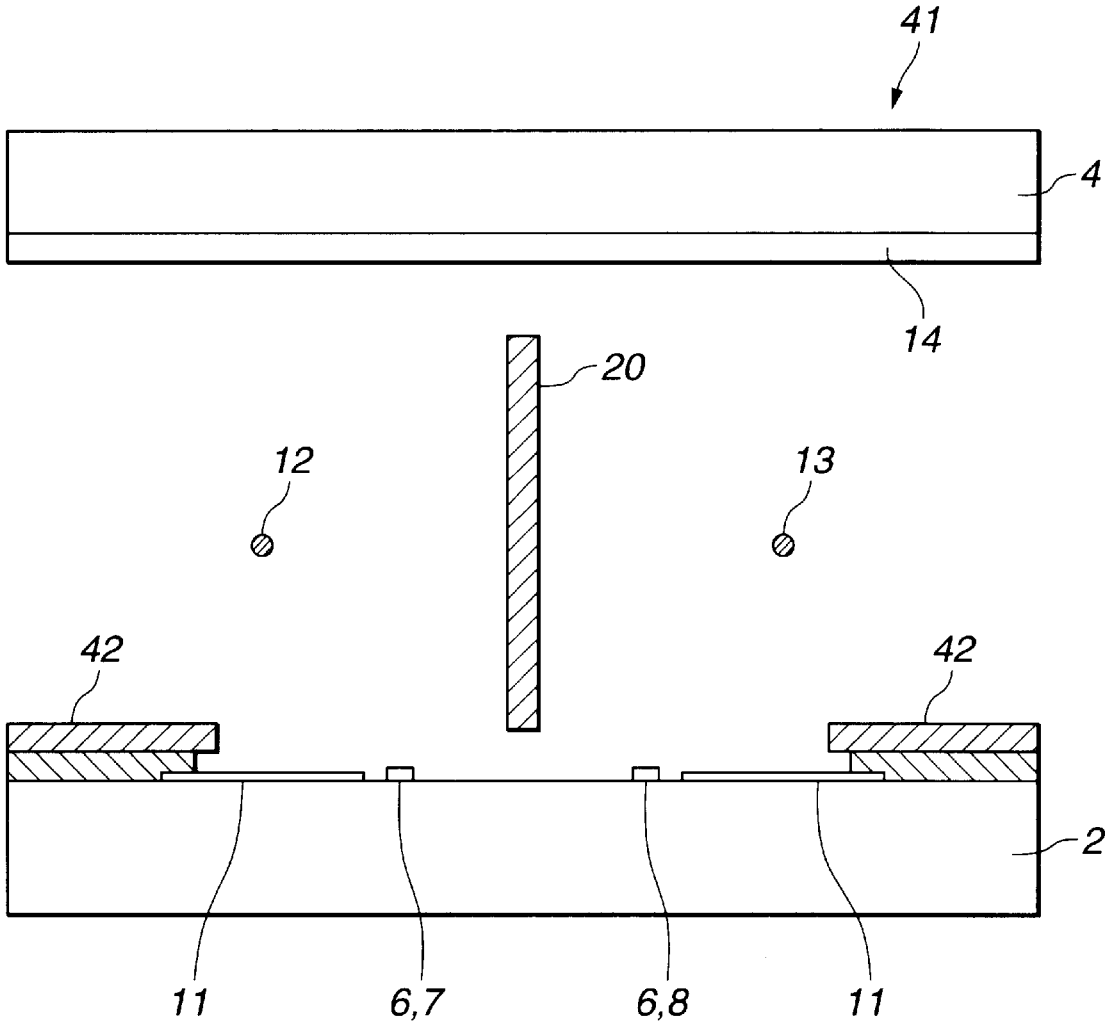
FIG. 5 is a schematic sectional view showing a second embodiment of a fluorescent luminous device according to the present invention.
Figure 6:
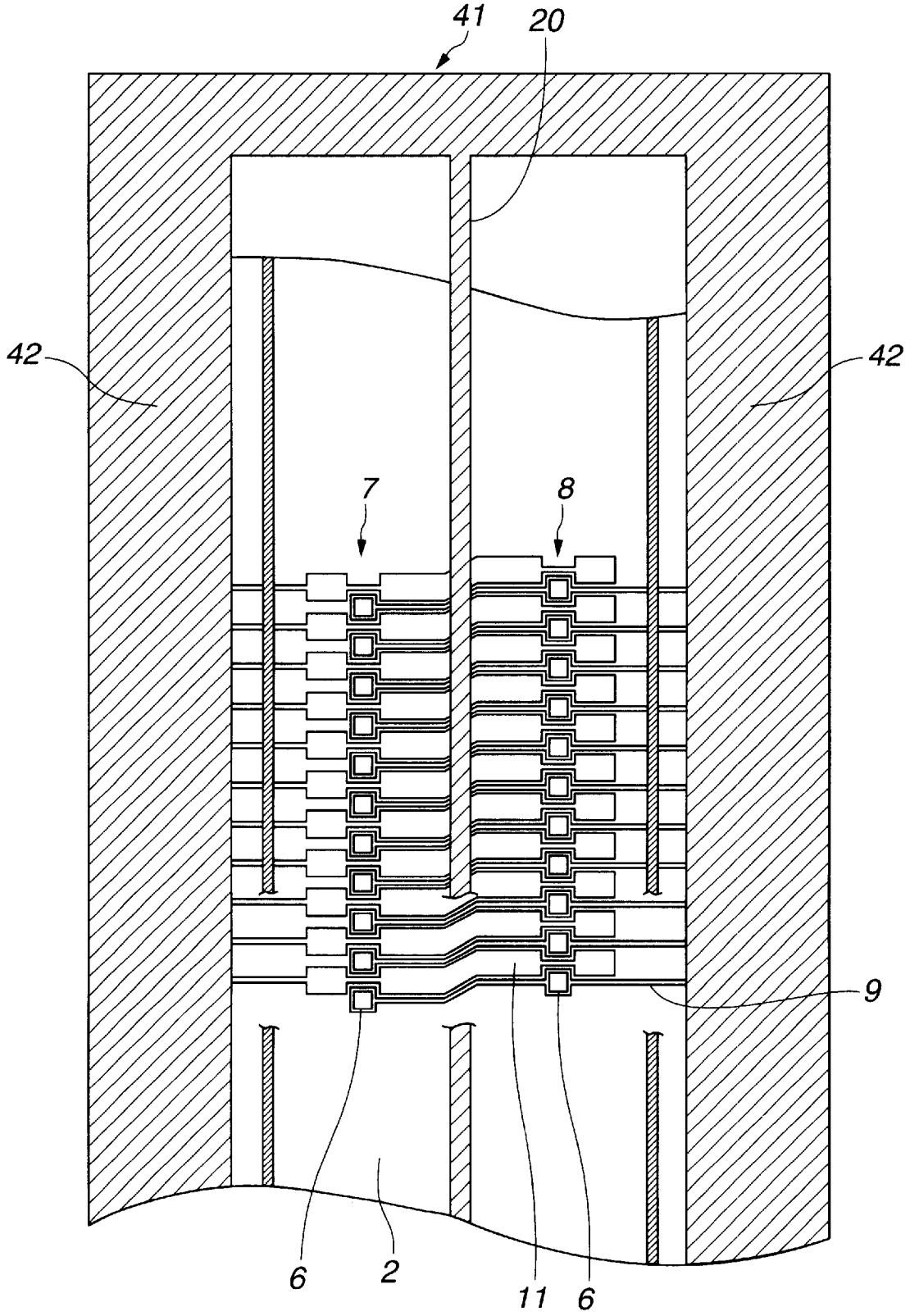
FIG. 6 is a fragmentary plan view of the fluorescent luminous device shown in FIG. 5.

Now, a second embodiment of a fluorescent luminous device according to the present invention will be described with reference to FIGS. 5 to 8 as well as FIG. 3. A fluorescent luminous device of the illustrated embodiment generally designated at reference numeral 41 is likewise constructed in the form of a fluorescent printer head and, as shown in FIGS. 5 and 6, includes a cut-off electrode 42 configured in a manner to be mechanically and electrically integral with a shield electrode 20. The cut-off electrode 42 is formed into a substantially frame-like configuration and arranged in parallel to an anode substrate 2 and somewhat away from the anode substrate 2 in a manner to surround two or first and second anode chains 7 and 8. A cut-off potential across the cut-off electrode 42 is set to be identical with a shield electrode potential Es. Also, in the illustrated embodiment, a drive circuit includes a Zener diode 43 connected between a pull-up resistor Rs and an anode potential Eb as shown in FIG. 3. Such construction permits the anode potential Eb to be constantly higher than a high-side cathode potential Ekh (Eb>Ekh). More specifically, the anode potential Eb is rendered higher by a potential corresponding to a Zener voltage than the high--side cathode potential Ekh. In the illustrated embodiment, the high-side cathode potential Ekh is set to be, for example, 20V. The remaining part of the second embodiment may be constructed in substantially the same manner as the first embodiment described above.

Figure 7:
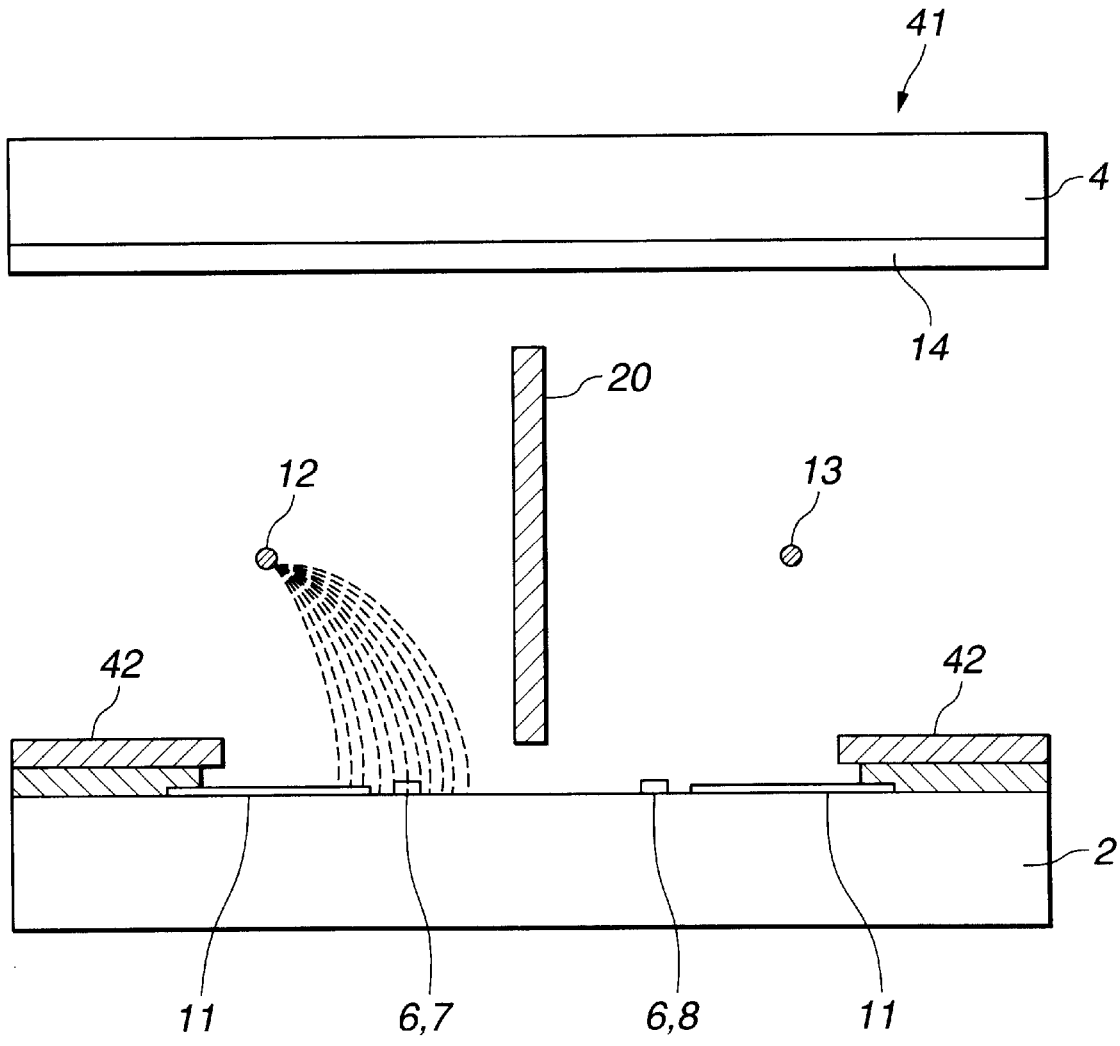
FIG. 7 is a schematic sectional view showing an electric field produced in the fluorescent luminous device of FIG. 5 during driving thereof.

Now, the manner of operation of the fluorescent printer head of the second embodiment thus constructed will be described with reference to FIG. 7. In FIG. 7, a first cathode 12 arranged on a left-hand side of the shield electrode 20 is set at Ek1=0V. Thus, a potential difference between the first cathode 12 and anode dots 6, that between the cathode 12 and flat control electrodes 11 and that between the cathode 12 and the cut-off electrode 42 are Eb–Ek1=40V, Ec–Ek1=40V and Es–Ek1=5V, respectively, to thereby permit electrons to be emitted from the first cathode 12 and reach the anode dots 6. At this time, a second cathode 13 arranged on a right-hand side of the shield 20 is kept at Ekh=20V. This results in a potential difference between the second cathode 13 and the anode dots 6, that between the cathode 13 and the flat control electrodes 11 and that between the cathode 13 and the cut-off electrode 42 being Eb–Ekh=20V, Ec–Ekh=20V and Es–Ekh=−15V, respectively. Thus, a potential difference between the second cathode 13 and each of the anode dots 6 and flat control electrodes 11 is reduced and the cut-off electrode 42 falls into substantially the same state as in the prior art wherein a negative potential of −15V is applied to the control electrodes, so that the second cathode 13 is kept from emitting electrons.

The first embodiment described above is so constructed that a potential difference between the selected cathode and the non-selected cathode is as large as 40V, to thereby cause electrons emitted from one of the cathodes to possibly travel beyond the shield electrode 20 toward the other cathode. Also, the first embodiment causes a part of electrons emitted from the cathode to flow into the flat control electrode 11, resulting in acting as a reactive current, leading to a deterioration in effective utilization of electric power.

Figure 8:
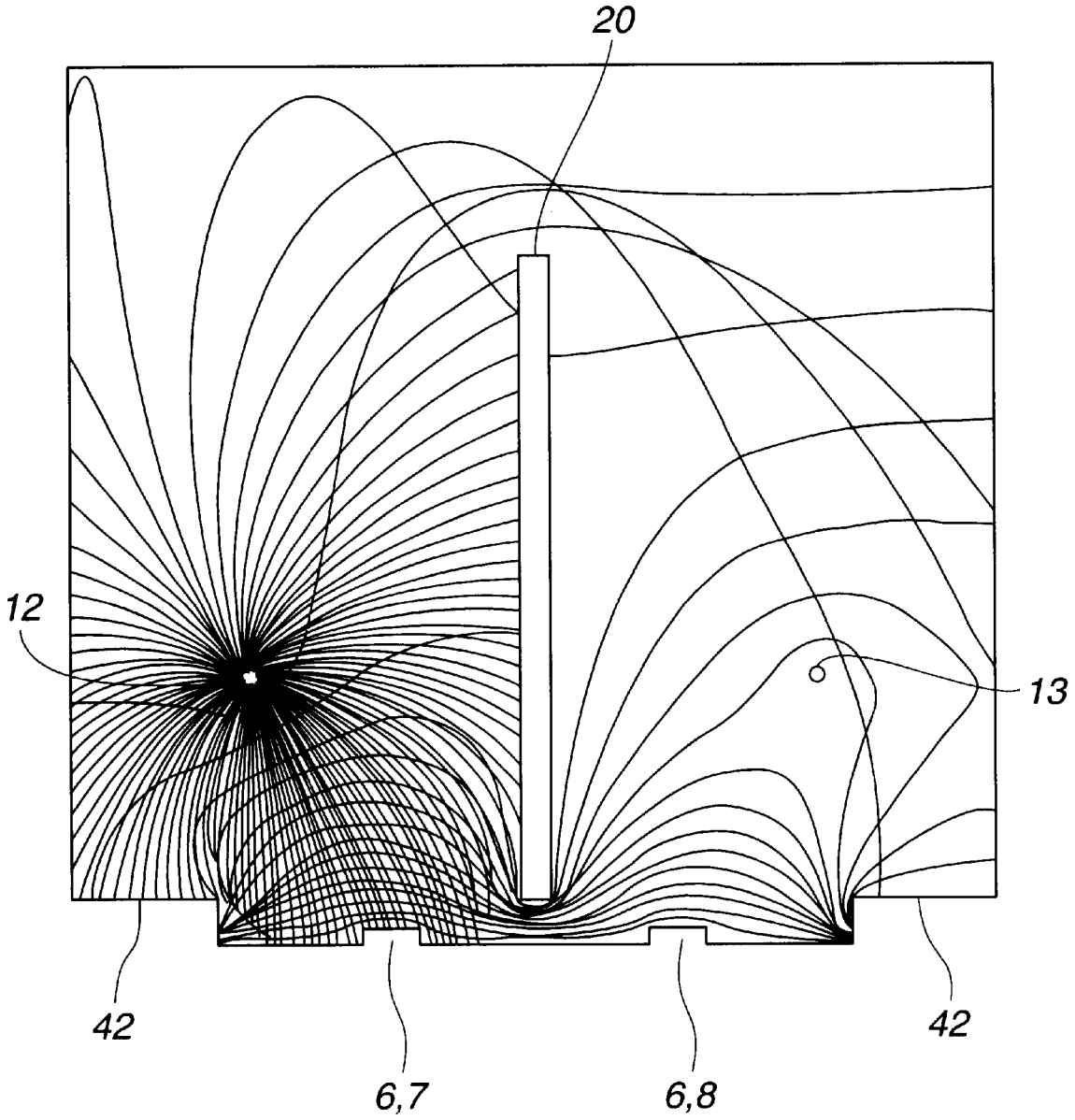
FIG. 8 is a view showing analysis of an electric field produced in the fluorescent luminous device of FIG. 5 during driving thereof.

On the contrary, the second embodiment is so constructed that the high-side cathode potential Ekh is set to be about 20V and the cut-off electrode is arranged. Such construction permits a potential difference between the selected cathode and the non-selected cathode to be as low as about 20V, to thereby prevent electrons from traveling beyond the shield electrode 20. Also, it, even when electrons travel beyond the shield electrode 20, prevents leakage luminescence due to impingement of the electrons on the anode dots 6 as shown in FIG. 8. Also, the cut-off electrode 42 restricts an ineffective area of each of the flat control electrodes 11, to thereby reduce a reactive current flowing through the flat control electrode 11. This permits down-sizing of a power supply, to thereby reduce dielectric strength of the IC incorporated in the printer head.

Figure 9:
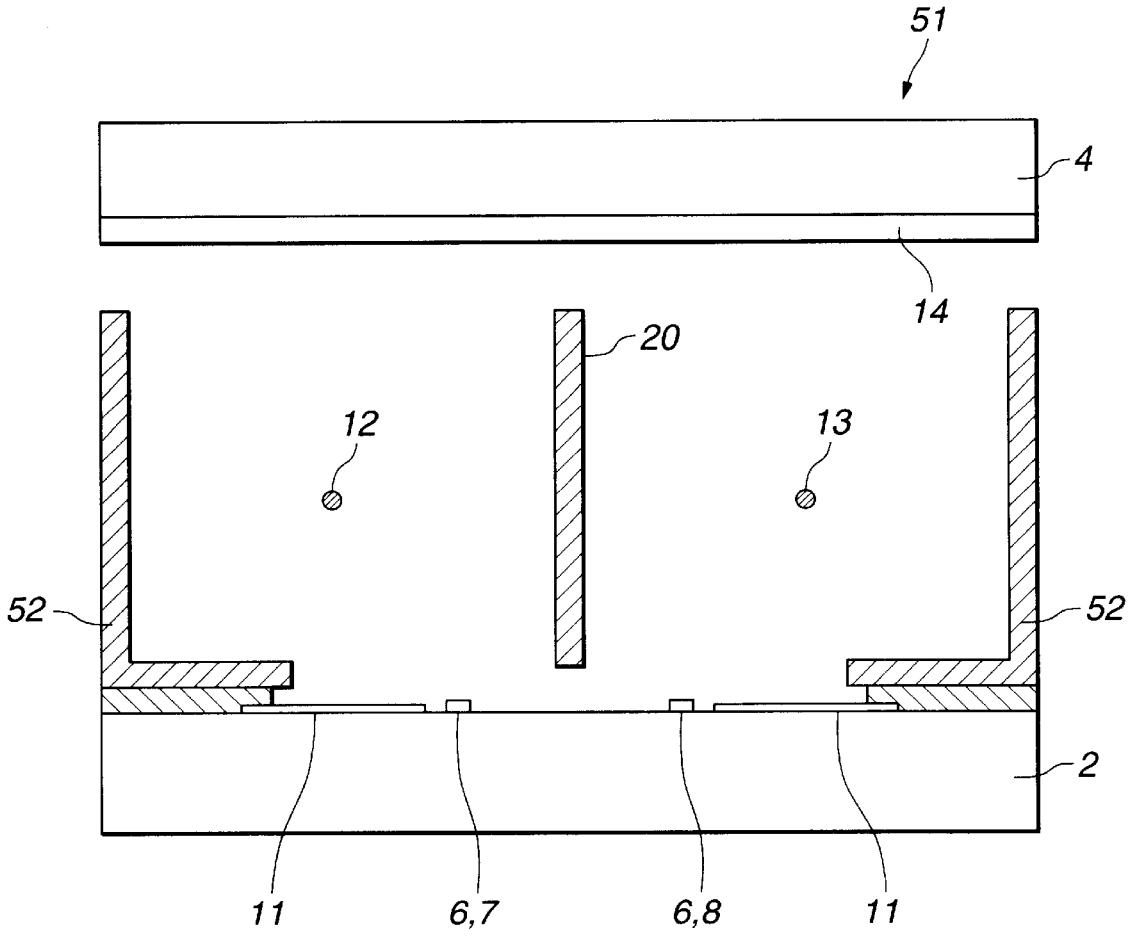
FIG. 9 is a schematic sectional view showing a third embodiment of a fluorescent luminous device according to the present invention.

Referring now to FIG. 9, a third embodiment of a fluorescent luminous device according to the present invention is illustrated. A fluorescent luminous device of the illustrated embodiment generally designated at reference numeral 51 is likewise constructed in the form of a fluorescent printer head and includes a cut-off electrode 52 formed into an L-shape in section. Such configuration of the cut-off electrode 52 permits the cut-off electrode to downwardly and laterally surround first and second cathodes 12 and 13, so that the cut-off electrode 52 may exhibit a further enhanced cut-off function, to thereby substantially reduce a high-side cathode potential Ekh. In the illustrated embodiment, the high-side cathode potential may be reduced to a level as low as 15V. In the second embodiment, as described above, it is set at 20V.

Figure 10:
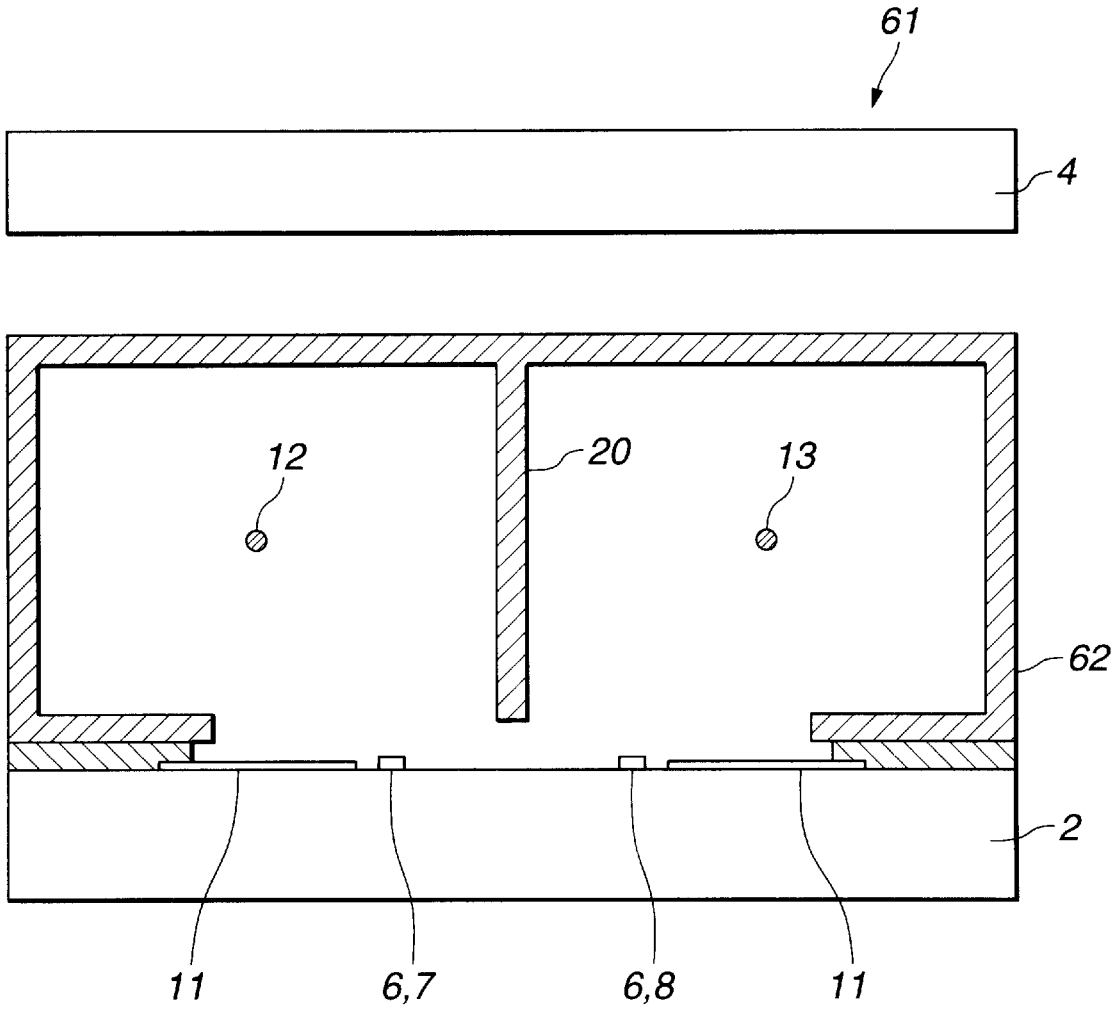
FIG. 10 is a schematic sectional view showing a fourth embodiment of a fluorescent luminous device according to the present invention.
Figure 11:
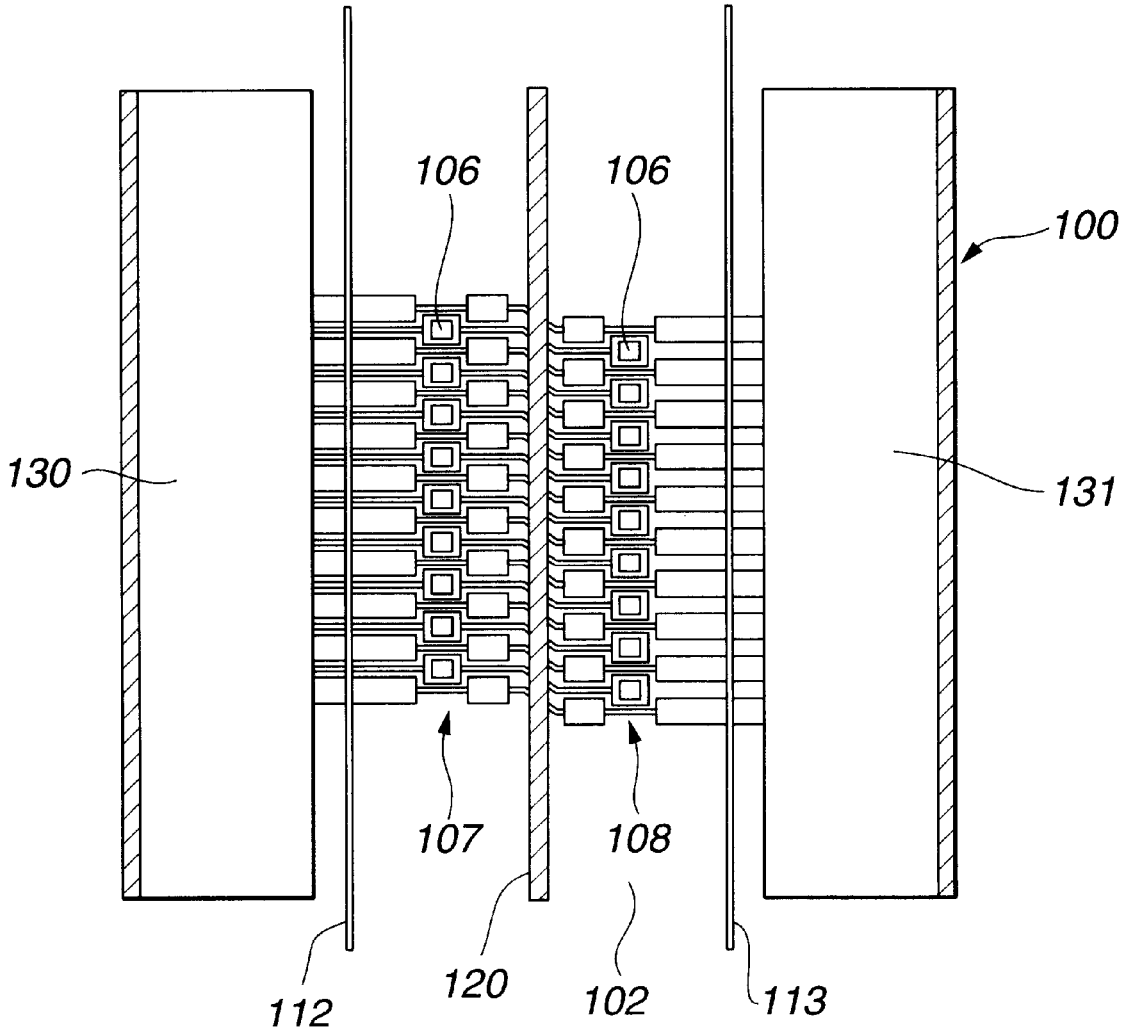
FIG.11 (PRIOR ART)
FIG. 11 is a plan view showing a conventional fluorescent printer head.

Referring now to FIG. 10, a fourth embodiment of a fluorescent luminous device according to the present invention is illustrated. A fluorescent luminous device of the illustrated embodiment generally designated at reference numeral 61 is likewise constructed in the form of a fluorescent printer head. In the fluorescent printer head 61, a cut-off electrode 62 is connected at an upper portion thereof to an upper end of a shield electrode 20, so that the cut-off electrode 62 and shield electrode 20 may be rendered integral with each other. The cut-off electrode 62 surrounds first and second cathodes 12 and 13 and the shield electrode 20 isolates the cathodes from each other. Thus, such construction further enhances a cut-off function of the cut-off electrode 62, to thereby further reduce a high-side cathode potential Ekh. In the illustrated embodiment, it may be set to be, for example, 10V, whereas in the third embodiment, it is set at 15V.

The fluorescent printer head of each of the embodiments described above each may be effectively applied to an optical printer head for forming a latent image on a photosensitive drum of a printing unit, an optical printer head for copying a video image on a developing paper or a film, an optical printer head for an optical record unit and the like.

In each of the embodiments described above, an AC power supply is used. Alternatively, a DC power supply may be substituted therefor. Also, two such anode chains and two such cathodes are arranged in the embodiments. Alternatively, three or more anode chains and cathodes may be arranged. For example, arrangement of a number of anode chains and a number of cathodes in each of the above-described embodiments provides a graphic display device significantly increased in display area.

Further, in each of the embodiments, one cathode is arranged for each of the anode chains. Alternatively, a plurality of cathodes may be arranged for each anode chain.

As can be seen from the foregoing, the fluorescent luminous device of the present invention includes the plural anode chains and the filamentary cathodes corresponding thereto, wherein a potential across the cathodes is changed over between a zero or negative potential and a positive potential to control the anode dots.

Such construction eliminates arrangement of control electrodes controllable independently from each other, leading to down-sizing of the fluorescent luminous device, a reduction in cost for parts of the device, a reduction in assembling cost of the device and a reduction in variation of luminance of the anode dots.

Also, in the present invention, the cut-off bias of the non-selected cathode is connected through the pull-up resistor to the anode power supply, to thereby utilize an anode potential. This eliminates a necessity of separately arranging a cut-off bias power supply for the cathodes and requires no power supply for a negative potential, resulting in the number of power supplies to be provided in the fluorescent luminous device being decreased.

When the cut-off bias of the non-selected cathode is connected through the pull-up resistor to the anode power supply, an increase in anode potential for the purpose of increasing luminance of the anode dots causes the cut-off bias of the non-selected cathode to be concurrently increased. In this case, the non-selected cathode is kept at the same positive potential as the anode on the basis of the selected cathode, to thereby promote intrusion of electrons from the selected cathode. This often results in a part of electrons emitted from the selected cathode intruding into the non-selected cathode beyond the shield electrode arranged between the cathodes, leading to leakage luminescence.

In view of such a problem, in the present invention, the cut-off electrode having the same potential as the shield electrode is arranged in proximity to the anode, to thereby limit the high-side cathode potential to a low level.

Further, in the present invention, the cut-off electrode may have an opening defined in an appropriate range, to thereby restrict flowing of electrons into other electrodes such as the flat control electrode, leading to a decrease in reactive current which does not contribute to luminescence. In addition, the anode substrate may be provided thereon with an insulating layer, to thereby prevent charging-up of electrons thereon.

In the prior art, an increase in anode potential for the purpose of providing increased luminance requires to increase a potential of the non-selected control electrode in a negative direction in order to prevent leakage luminescence, resulting in a potential difference therebetween being highly increased. Also, both are arranged in proximity to each other, to thereby readily cause dielectric breakdown. On the contrary, the present invention is constructed so as to prevent such an increase in potential difference, to thereby eliminate the problem.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent luminous device comprising:

an anode substrate;

an anode including a plurality of anode chains, wherein each of said anode chains includes a plurality of anode dots spaced at predetermined intervals on said anode substrate, and wherein said anode dots of said anode chains are connected to corresponding anode dots of other anode chains of said plurality of anode chains;

an anode drive means for driving said anode dots;

a plurality of cathodes arranged above respective anode chains of said plurality of anode chains; and cathode selection means for applying voltages to respective cathodes of said plurality of cathodes independently from other cathodes of said plurality of cathodes, so as to select said anode chains.

2. A fluorescent luminous device as defined in claim 1, wherein said cathode selection means applies a positive potential to said cathodes non-selected and a zero or negative potential to said cathodes selected.

3. A fluorescent luminous device as defined in claim 1, further comprising a shield electrode arranged between each two of said cathodes so as to separate spaces above said anode chains from each other;

said shield electrode having a zero or positive potential applied thereto.

4. A fluorescent luminous device as defined in claim 1, further comprising a cut-off electrode having a potential lower than a positive potential which is applied to said cathodes applied thereto.

5. A fluorescent luminous device as defined in claim 4, wherein the positive potential applied to said cathodes is lower than a positive potential applied to said anode.

6. A fluorescent luminous device as defined in claim 1, further comprising a shield electrode arranged between each two of said cathodes so as to separate spaces above said anode chains from each other and a cut-off electrode for preventing electrons from being discharged from said cathodes non-selected to said anode chains corresponding thereto;

said shield electrode and cut-off electrode being integrally constructed so as to cover said cathodes and having a potential lower than a positive potential which is applied to said cathodes applied thereto.

* * * * *